US007432898B2

(12) United States Patent
Tsutsui et al.

(10) Patent No.: US 7,432,898 B2
(45) Date of Patent: Oct. 7, 2008

(54) ACTIVE MATRIX DISPLAY DEVICE

(75) Inventors: Yusuke Tsutsui, Hashima (JP); Ryoichi Yokoyama, Ogaki (JP); Michiru Senda, Anpachi-Gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 277 days.

(21) Appl. No.: 11/212,742

(22) Filed: Aug. 29, 2005

(65) Prior Publication Data

US 2005/0280621 A1 Dec. 22, 2005

Related U.S. Application Data

(62) Division of application No. 10/134,036, filed on Apr. 29, 2002, now Pat. No. 6,956,553.

(30) Foreign Application Priority Data

Apr. 27, 2001 (JP) ..... 2001-132868
Apr. 27, 2001 (JP) ..... 2001-132869
Apr. 27, 2001 (JP) ..... 2001-132870
Apr. 27, 2001 (JP) ..... 2001-132871
Apr. 27, 2001 (JP) ..... 2001-132872

(51) Int. Cl.
*G09G 3/36* (2006.01)

(52) U.S. Cl. ..... 345/92; 345/90

(58) Field of Classification Search ..... 345/90, 345/92, 94, 96, 98; 349/33, 85, 129
See application file for complete search history.

(56) References Cited

U.S. PATENT DOCUMENTS 4,712,877 A 12/1987 Okada
5,016,982 A 5/1991 Fergason
5,124,695 A 6/1992 Green
5,204,659 A 4/1993 Sarma
5,296,870 A 3/1994 Nicholas
5,712,652 A 1/1998 Sato et al.
5,790,090 A 8/1998 Libsch et al.
5,945,972 A 8/1999 Okumura et al.
5,952,991 A 9/1999 Akiyama
5,977,940 A 11/1999 Akiyama et al.
6,023,308 A 2/2000 Takemura
6,072,454 A 6/2000 Nakai et al.
6,115,017 A 9/2000 Mikami
6,344,889 B1 * 2/2002 Hasegawa et al. ..... 349/129
6,456,267 B1 9/2002 Sato
6,771,247 B2 * 8/2004 Sato et al. ..... 345/98
6,819,311 B2 11/2004 Nose

FOREIGN PATENT DOCUMENTS

EP 0 797 182 9/1997

(Continued)

*Primary Examiner*—Kevin M Nguyen
(74) *Attorney, Agent, or Firm*—Morrison & Foerster LLP

(57) ABSTRACT

In the active matrix display device with a DRAM as the retaining circuit, the voltage retained in the retaining circuit is set in the brightness saturation region, which is outside the region of the voltage used in the moving picture display mode. With the voltage in this region, the difference in the brightness will not be recognized even if the voltage decreases before the refreshing operation. This prevents flickering and improves the display quality.

23 Claims, 5 Drawing Sheets

FOREIGN PATENT DOCUMENTS

| | | | |
|---|---|---|---|
| EP | 1 020 840 | | 7/2000 |
| JP | 56-88193 | A | 7/1981 |
| JP | 58-23091 | | 2/1983 |
| JP | 58-220185 | A | 12/1983 |
| JP | 08-194205 | | 7/1996 |
| JP | 09-236823 | | 9/1997 |
| JP | 09-243995 | A | 9/1997 |
| JP | 11-326874 | A | 11/1999 |
| JP | 2000-282168 | A | 10/2000 |
| JP | 2001-242819 | | 9/2001 |

* cited by examiner

ACTIVE MATRIX DISPLAY DEVICE

REFERENCE TO RELATED APPLICATION

This application is a division of Ser. No. 10/134,036, filed Apr. 29, 2002.

BACKGROUND OF THE INVENTION

1. Field of the Invention

This invention relates to an active matrix display device, specifically to an active matrix display device in which a plurality of retaining circuits are disposed corresponding to a pixel element.

2. Description of the Related Art

There has been a great demand on the market for portable devices with a display such as a portable TV and a portable telephone. All these devices need a small, lightweight and low-power consumption display device. Development efforts have been made accordingly.

FIG. 5 shows a circuit diagram of one display pixel element of a conventional liquid crystal display device. On an insulating substrate 101, a plurality of gate signal lines 102 are disposed in one direction. A plurality of analog signal lines 103 are disposed in a direction perpendicular to the gate signal lines 102. Near the crossing of both signal lines, a pixel element selection thin film transistor 104 connected to both signal lines 102, 103 is disposed. The thin film transistor will be referred to as the TFT hereafter. The analog signal line 103 is connected to a pixel element electrode 105 through the pixel element selection TFT 104. A storage capacitance element 106 for holding the voltage of the pixel element electrode 105 for one field period is formed. The pixel element selection TFT 104 is connected to one terminal of the storage capacitance element 106. The common voltage among the display pixel elements is provided with to the other terminal 107 of the storage capacitance element 106. The pixel element selection TFT 104, pixel element electrode 105, and storage capacitance element 106 are disposed for each of the pixel elements.

A gate driver 108 and a drain driver 109 are formed in the peripheral area of the substrate 101. A plurality of the gate signal lines 102 are connected to the gate driver 108 and provided with sequentially scanning signals. A plurality of the analog signal lines 103 are connected to the drain driver 109, which supplies the image signal voltage corresponding to each of the analog image signal lines 103. When the scanning signal (H level) is applied to the gate signal line 102, the pixel element selection TFT 104 connected to the gate signal line 102 turns on. An analog image signal is then transmitted to the pixel element electrode 105 through the analog signal line 103 and retained in the storage capacitance element 106. The image signal voltage applied to the pixel element electrode 105 is then applied to a liquid crystal, which aligns itself in response to the applied voltage, acquiring the liquid crystal display. Therefore, the liquid crystal display device can implement both a moving picture display and a still picture display.

In Japanese Laid-Open Patent Publication No. Hei 8-194205, a display device, in which a memory element is disposed for each of the pixel elements, and in which the drive of peripheral circuits is halted during the still picture display, is disclosed. Thus, power consumption by the display device is reduced.

FIG. 6 is a circuit diagram of one pixel element of the conventional active matrix display device with a memory element.

On the insulating substrate 101, the gate signal line 102 and an address signal line 121 are disposed crossing each other. Near the crossing, a pixel element selection TFT 122 connected to both signal lines 102, 121 is formed. Also, digital signal lines 123 are formed in the direction parallel to the address signal line. The number of the digital signal lines 123 corresponds to the number of the bits of the digital signal supplied to one row of the pixel elements. In the figure, the number of the bits is four, and thus, four digital signal lines are disposed. Each of the digital signal lines 123 is connected to a memory element 124. When the pixel element selection TFT 122 turns on, the memory element 124 holds the voltage of the digital signal line 123 as the binary voltage, which is either on or off. The output from the memory element 124 is inputted to the gate of a sub-pixel element TFT 125 for controlling whether it is on of off. Each of the sub-pixel element TFTs 125 is connected to a sub-pixel element electrode 126. A reference voltage Ref is supplied to the sub-pixel element electrode 126, to which the sub-pixel element TFT 125 in the ON state is connected.

The gate driver 108 and a drain driver 127 are disposed in the peripheral area of the substrate 101. A plurality of the gate signal lines 102 are connected to the gate driver 108, which sequentially supplies the scanning signal. A plurality of the address signal lines 121 and the digital signal lines 123 are connected to the drain driver 127, which supplies the image signal voltage corresponding to each of the digital signal lines 123. When the scanning signal (H level) is applied to the gate signal line 102 and the address signal line 121, the pixel element selection TFT 122 connected to these signal lines turns on activating the memory element 124. At the same time, a digital image signal is transmitted to the memory element 124 from the digital signal line 123. The digital data is 4-bit data. The least significant bit DO is transmitted to the digital signal line 123*a* and the most significant bit D3 is transmitted to the digital signal line 123*d*. When each bit data is high, the memory element 124 holds the data for outputting the high signal. The sub-pixel element TFT 125, to which the memory element 124 holding the high is connected, turns on. This provides the reference voltage to the sub-pixel element electrode 126, which is connected to the sub-pixel element TFT 125. Each of the sub-pixel element electrodes 126 has a different area. The area ratio of the sub-pixel element electrodes 126*a*-126*d* is as follows; 126*a*:126*b*:126*c*:126*d*=1:2:4:8. Therefore, by controlling the on and off operation of each sub-pixel element electrode 126 independently, the four-bits or 16-level gray scale display is possible.

The display device with the above configuration can reduce power consumption for a still picture display compared to a normal display. That is, it is also possible to keep showing the still picture with the drive of the gate driver 108 and the drain driver 127 halted when the memory element 124 is a SRAM, which is capable of retaining the data until the next data is over-written. When the memory element 124 is a DRAM, it is possible to slow down the operating cycle of the gate driver 108 and the drain driver 127 to a refresh cycle.

Next, the problems of the prior art will be explained. As described above, disposing the memory element for each pixel element can reduce power consumption. However, when the DRAM is used as the memory element, the quality of the display is significantly deteriorated because of fluctuations in the brightness or so-called flicker for each pixel element upon each refreshing operation.

In the prior art, arbitrary numbers of the sub-pixel element electrodes 126 are selected to receive the signal according to the data to be displayed. The sub-pixel element electrode to be made a bright spot and the sub-pixel element electrode to be made a dark spot exist mixed in one pixel element and the gray scale is expressed in terms of the area of the bright spot. This is because it is not possible to express the gray scale with the voltage in the still picture display mode. This is because the retaining circuit can only hold the binary data of high or low in the still picture display mode. However, the disposition of the sub-pixel element electrodes 126 shown in FIG. 6 has the following problem. That is, the distance between the bright spots differs between the case where the pixel element with the bright sub-pixel element electrode 126*a* only is adjacent to the pixel element with the bright sub-pixel element electrode 126*d* only and the case where the two pixel elements with all the sub-pixel element electrodes 126*a*-126*d* bright are located adjacent to each other. This causes the deterioration of the display quality, such as jagged lines, a dull edge, reduced resolution and an inappropriate mixing of R, G, and B.

Periodically inverting the direction of the electric field applied to the liquid crystal in a predetermined cycle is performed commonly because applying the electric field in one direction causes deterioration of the liquid crystal. In the moving picture display mode, the direction of the electric field is inverted once in each frame. That is, the inverting cycle is about 60 Hz. Also, when a DRAM is used as the memory element, there is leakage from the storage capacitance element in the DRAM, requiring a refreshing operation for the retained data with a predetermined cycle, as described before. Each of the inverting operation and the refreshing operation has an independent circuit and an independent cycle. Therefore, the circuit for the inverting operation and the circuit for the refreshing operation should be disposed independently.

Also, in the display device of the prior arts, the circuit for the moving picture display and the circuit for the still picture display are disposed in parallel and switching between the moving picture display mode and the still picture display mode is performed. Therefore, the circuits for each display mode should be integrated in each of the pixel elements. That is, the number of the elements disposed in one pixel element is relatively large, making reducing the size of the pixel element difficult. It is also difficult to make the high-resolution liquid crystal display device and to increase the number of the bits of the retained data.

Therefore, this invention is directed to offering an active matrix display device with a high quality display by preventing flickering when refreshing the DRAM.

The invention is also directed to improving the display quality of the active matrix display device, which has a retaining circuit corresponding to the sub-pixel element electrode in the still picture display mode.

Furthermore, this invention is directed to reducing the circuit size. Further size reduction of the display device can be achieved by reducing the circuit size of the peripheral driver circuits of the active matrix display device. Also, this invention is directed to improve the manufacturing yield.

This invention is further directed to an active matrix display device which is capable of retaining data with multiple-bits, and which can be made smaller by reducing the number of the elements integrated in one pixel element.

SUMMARY OF THE INVENTION

This invention is directed to solve the problems described above. In an active matrix display device having a plurality of pixel element electrodes disposed for each of pixel elements and a retaining circuit disposed corresponding to the pixel element electrode, a display is made by supplying the voltage retained in the retaining circuit to the pixel element electrode. The voltage retained in the retaining circuit is set in a brightness saturation region in which the displayed brightness does not change even with slight voltage changes.

The active matrix display device of this invention comprises a pair of substrates facing each other and a liquid crystal sealed in between the substrates. A plurality of the pixel element electrodes disposed for each pixel element and the retaining circuit corresponding to the pixel element electrode are formed on one of the substrates. On the other substrate, a common electrode facing a plurality of the pixel element electrodes is formed. The light transmission factor of the liquid crystal changes as the pixel element voltage applied between the pixel element electrode and the common electrode increases. When the pixel element voltage is higher than the voltage in a linear region, the voltage is in the brightness saturation region, where the transmission factor of the liquid crystal does not change even with the voltage increase. In the active matrix display device, which produces a display according to the pixel element voltage retained in the retaining circuit, the voltage retained in the retaining circuit is set in the brightness saturation region.

Furthermore, at the retaining circuit, a refreshing operation is performed before a certain length of time passes to keep the retaining voltage at a certain level. If the voltage retained in the retaining circuit goes down by $\Delta V$ in the duration between refreshing operations, the voltage retained in the retaining circuit is higher than the linear region voltage of the brightness saturation region by at least $\Delta V$.

The active matrix display device of this invention comprises a pair of substrates facing each other and the liquid crystal sealed in between the substrates. On one of the substrates, a plurality of the pixel element electrodes disposed for each of the pixel elements and the retaining circuit corresponding to the pixel element electrode are formed. On the other substrate, the common electrode facing to a plurality of the pixel element electrodes is formed. The light transmission factor of the liquid crystal changes as the pixel element voltage applied between the pixel element electrode and the common electrode increases. When the pixel element voltage is higher than a linear region voltage, the voltage is in the brightness saturation region where the transmission factor of the liquid crystal does not change even with a voltage increase. Therefore, in the active matrix display device, which produces a display according to the pixel element voltage retained in the retaining circuit, the voltage retained in the retaining circuit is set at the voltage in which the transmission factor is lower than 10% or higher than 90% when the transmission factor in the brightness saturation region is 100%.

The active matrix display device of this invention comprises a pair of the substrates facing each other and liquid crystal sealed in between the substrates. On one of the substrates, a plurality of the pixel element electrodes disposed for each of the pixel elements and the retaining circuit corresponding to the pixel element electrode are formed. On the other substrate, a common electrode facing a plurality of the pixel element electrodes is formed. The light transmission factor of the liquid crystal changes as the pixel element voltage applied between the pixel element electrode and the common electrode increases. When the pixel element voltage is higher than the voltage in the linear region, the voltage is in the brightness saturation region where the transmission factor of the liquid crystal does not change even with a voltage increase. In the active matrix display device switching between a moving picture display mode, in which the display is sequentially made according to the image signal sequentially inputted, and a still picture display mode, in which the display is made by using the voltage retained in the retaining circuit as the pixel element voltage, the voltage retained in the retaining circuit is set outside of the region of the voltage used as the pixel element voltage in the moving picture display mode.

Additionally, the pixel element electrode comprises a plurality of sub-pixel element electrodes electrically insulated from each other. All of the sub-pixel element electrodes forming one pixel element electrode have different areas.

The retaining circuit has a retaining capacitance element for holding the voltage.

In the active matrix display device having a plurality of pixel element electrodes disposed for each of the pixel elements and a retaining circuit disposed corresponding to the pixel element electrode, a display is made by supplying the voltage retained in the retaining circuit to the pixel element electrode. The pixel element electrode comprises a plurality of sub-pixel element electrodes with different surface areas. Turning on and off of the sub-pixel element electrode is independently controlled according to the retained voltage in the retaining circuit. The sub-pixel element electrodes are disposed symmetrically with the horizontal and/or vertical axis of the symmetry run through the center of the pixel element.

Among the sub-pixel element electrodes, the smallest pixel element electrode is placed in the center of the pixel element. The second smallest sub-pixel element electrode is disposed to surround the smallest sub-pixel element electrode. In this manner, the n-th smallest sub-pixel element electrode is disposed to surround the n−1 th smallest sub-pixel element electrode.

Furthermore, the smallest sub-pixel element electrode is rectangular. Other larger sub-pixel element electrodes have rectangular peripheries and rectangular openings in the middle.

The active matrix display device of this invention comprises a pair of substrates facing each other and the liquid crystal sealed in between the substrates. On one of the substrates, a plurality of the pixel element electrodes disposed for each of the pixel elements and the retaining circuit corresponding to the pixel element electrode are formed. On the other substrate, the common electrode facing a plurality of the pixel element electrodes is formed. The voltage retained in the retaining circuit is applied between the pixel element electrode and the common electrode as the pixel element voltage, for forming an image. The retaining circuit has a retaining capacitance element for holding the voltage. A refreshing operation to refresh the retained voltage is performed with a first cycle and an inverting operation to invert the voltage retained in the retaining circuit for inverting the direction of the electric field applied to the liquid crystal is performed with a second cycle. The refreshing operation is synchronized with the inverting operation. The second cycle is an integral multiple of the first cycle. Furthermore, the first and second cycles may be the same cycle.

The active matrix display device of this invention comprises a pair of substrates facing each other and liquid crystal sealed in between the substrates. On one of the substrates, a plurality of the pixel element electrodes disposed for each of the pixel elements and the retaining circuit corresponding to the pixel element electrode are formed. On the other substrate, the common electrode facing a plurality of the pixel element electrodes is formed. The light transmission factor of the liquid crystal changes as the pixel element voltage, which is the difference in voltage between the pixel element electrode and the common electrode, increases. When the pixel element electrode voltage is higher than a linear region voltage, the voltage is in the brightness saturation region, where the transmission factor of the liquid crystal does not change even with an increase in the pixel element voltage. The retaining circuit holds the voltage in the brightness saturation region and the display is made by using the voltage retained in the retaining circuit as the pixel element voltage. In the active matrix display device with the above configuration, the voltage of the retaining circuit is inverted in order to invert the direction of the electric field applied to the liquid crystal with a faster cycle than the duration, during which the voltage retained in the retaining circuit decreases below the linear region voltage.

The active matrix display device of this invention comprises a plurality of gate signal lines disposed on a substrate, a plurality of image signal lines disposed in the direction perpendicular to the gate signal lines, a plurality of the pixel element electrodes disposed for each pixel element, each of which has a plurality of the sub-pixel element electrodes electrically insulated from each other, and a retaining circuit disposed corresponding to the sub-pixel element electrode for holding the data based on the image signal. Different image signal lines are placed for each of the retaining circuits disposed for one pixel element. The retaining circuit retains the data based on the image signal provided through each of the image signal lines. The display device has a still picture display mode, in which the display is made according to the data retained in the retaining circuit, and a moving picture display mode, in which each pixel element voltage corresponding to the image signal sequentially supplied is sequentially applied to the sub-pixel element electrode through each of the image signal lines to make the display. In the moving picture display mode, the same voltage is supplied to a plurality of the sub-pixel element electrodes corresponding to one pixel element.

Furthermore, the image signal line and the retaining circuit are connected through a pixel element selection TFT, and the pixel element selection TFTs disposed for one pixel element turn on and off simultaneously.

Additionally, the retaining circuit has a retaining capacitance element for holding the voltage. The retaining capacitance element functions as a storage capacitance element in the moving picture display mode.

Each of the sub-pixel element electrodes forming one pixel element electrode has different area from each other.

The active matrix display device of this invention comprises a pair of the substrates facing each other and liquid crystal sealed in between the substrates. On one of the substrates, a plurality of the pixel element electrodes, each of which has a plurality of sub-pixel element electrodes having a different area, and which are disposed for each of the pixel elements, and the retaining circuit having the retaining capacitance element for holding the voltage disposed corresponding to each of the sub-pixel element electrodes are formed. On the other substrate, the common electrode facing a plurality of the pixel element electrodes is formed. At the pixel element electrode, turning on and off each of the sub-pixel element electrodes is independently controlled. The sum of the capacitance value C of the retaining capacitance element corresponding to each sub-pixel element electrode and the liquid crystal capacitance CLC formed by the sub-pixel element electrode and the common electrode with the liquid crystal therebetween is practically the same among the sub-pixel element electrodes.

The active matrix display device of this invention comprises a pair of substrates facing each other and the liquid crystal sealed in between the substrates. On one of the substrates, a plurality of the pixel element electrodes, each of which has a plurality of the sub-pixel element electrodes having a different area, and which are disposed for each of the pixel elements, and the retaining circuit having a retaining capacitance element for holding the voltage disposed corresponding to each of the sub-pixel element electrodes are formed. On the other substrate, the common electrode facing a plurality of the pixel element electrodes is formed. At the pixel element electrode, turning on and off each of the sub-pixel element electrodes is independently controlled. The capacitance value C of the retaining capacitance element corresponding to each sub-pixel element electrode is set higher as the size of the corresponding sub-pixel element electrode is smaller.

The active matrix display device of this invention comprises a pair of substrates facing each other and the liquid crystal sealed in between the substrates. On one of the substrates, a plurality of the pixel element electrodes, each of which has a plurality of the sub-pixel element electrodes having a different area, and which are disposed for each of the pixel elements, and the retaining circuit having a retaining capacitance element for holding the voltage disposed corresponding to each of the sub-pixel element electrodes are formed. On the other substrate, the common electrode facing a plurality of the pixel element electrodes is formed. At the pixel element electrode, the turning on and off each of the sub-pixel element electrodes is independently controlled. The capacitance value C of the retaining capacitance element corresponding to each sub-pixel element electrode is larger than the liquid crystal capacitance CLC formed by the sub-pixel element electrode and the common electrode with the liquid crystal therebetween.

The active matrix display device of this invention comprises a pair of substrates facing each other and the liquid crystal sealed in between the substrates. On one of the substrates, a plurality of the pixel element electrodes, each of which has a plurality of sub-pixel element electrodes having a different area, and which are disposed for each of the pixel elements, and the retaining circuit having a retaining capacitance element for holding the voltage disposed corresponding to each of the sub-pixel element electrodes are formed. On the other substrate, the common electrode facing a plurality of the pixel element electrodes is formed. At the pixel element electrode, turning on and off each of the sub-pixel element electrodes is independently controlled by a plurality of the pixel element selection transistors connected to the sub-pixel element electrode. The capacitance value C of the retaining capacitance element corresponding to each sub-pixel element electrode and a channel width W of the pixel element selection transistor are determined according to the surface area of the corresponding sub-pixel element electrode.

DETAILED DESCRIPTION OF THE INVENTION

Figure 1:
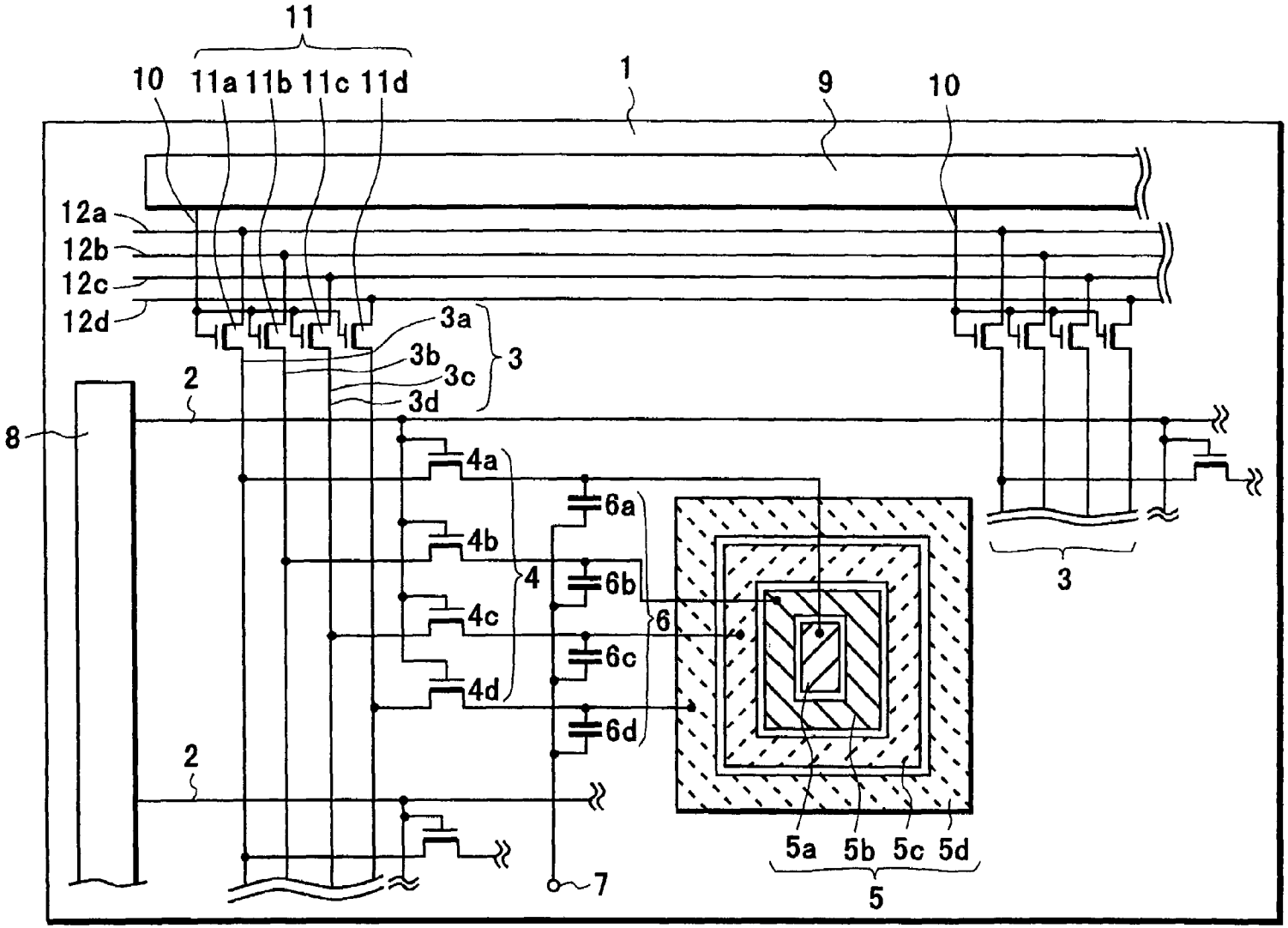
FIG. 1 is a circuit diagram of an active matrix display device of an embodiment of this invention.

FIG. 1 is a circuit diagram of the active matrix display device showing an embodiment of this invention.

On an insulating substrate 1 made of a material such as non-alkaline glass, gate signal lines 2 and image signal lines 3 are placed crossing each other. A plurality of pixel element selection TFTs 4 connected to both signal lines are disposed corresponding to the crossing of the two signal lines. The number of the image signal lines 3 is determined according to the number of the bits of digital signal supplied to each row. In the figure, the number of the bits is four and, thus, four signal lines are disposed. When the image signal line 3 corresponding to each bit is referred to independently, each signal line will be expressed as 3*a*, 3*b*, 3*c*, and 3*d*, respectively. When these image signal lines are referred to as one unit, they will be expressed as the image signal line 3. Likewise, as to the configurations disposed corresponding to each bit, letters a, b, c, and d will be added to the reference numerals to make the distinction. The image signal line 3 is connected to a sub-pixel element electrode 5 through the pixel element selection TFT 4. Also, a retaining capacitance element 6 is placed for each of the sub-pixel element electrodes 5 as a memory element for retaining the voltage of the sub-pixel element electrode 5 for a certain period of time. One electrode of the retaining capacitance element 6 is connected to the pixel element selection TFT 4, and the other electrode 7 is provided with the voltage common among the display pixel elements. The pixel element selection TFT 4. The sub-pixel element electrode 5, and the retaining capacitance element 6 are disposed for each of the pixel elements.

A gate driver 8 and a drain driver 9 are disposed in the peripheral area of the substrate 1. A plurality of the gate signal lines 2 are connected to the gate driver 8, which sequentially supplies a scanning signal. A column selection line 10 is connected to the drain driver 9, which sequentially provides a column selection signal. The column selection line 10 is connected to the gate of a column selection TFT 11. A common image signal line 12 is disposed in the direction perpendicular to the image signal line 3 of each column and connected to the image signal line 3 of each column through the column selection TFT 11.

A common electrode, which is placed facing a plurality of the pixel elements, and a color filter are disposed on the second substrate, which is facing the substrate 1. A liquid crystal is sealed between the two substrates forming the liquid crystal display device. The explanation about the configuration on the second substrate will be omitted, for it is the same as the configuration generally known.

The column selection TFTs 11, whose number is determined according to the number of bits, is disposed for each column of the pixel element electrodes. One column selection line 10 is commonly connected to the gates of the column selection TFTs 11*a*, 11*b*, 11*c*, and 11*d*, which turn on and off simultaneously. When the column selection TFT 11 turns on, the image signal line 3 is connected to the common image signal line 12 receiving an image signal voltage corresponding to the each bit of the digital signal.

The display device of this invention has a moving picture display mode in which a moving picture is displayed by the sequentially inputted image signal and a still picture display mode in which a still picture is display by retaining the image signal. In the still picture display mode, power consumption can be reduced. Each display mode will be explained hereinafter.

(1) Moving Picture Display Mode

Figure 5:
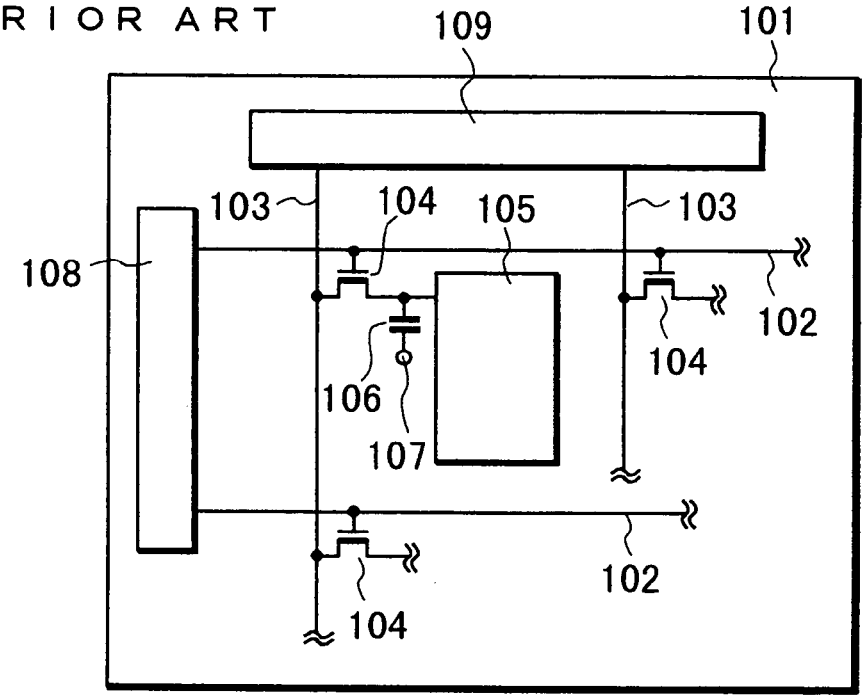
FIG.5 PRIOR ART
FIG. 5 is a circuit diagram of a conventional active matrix display device.
Figure 6:
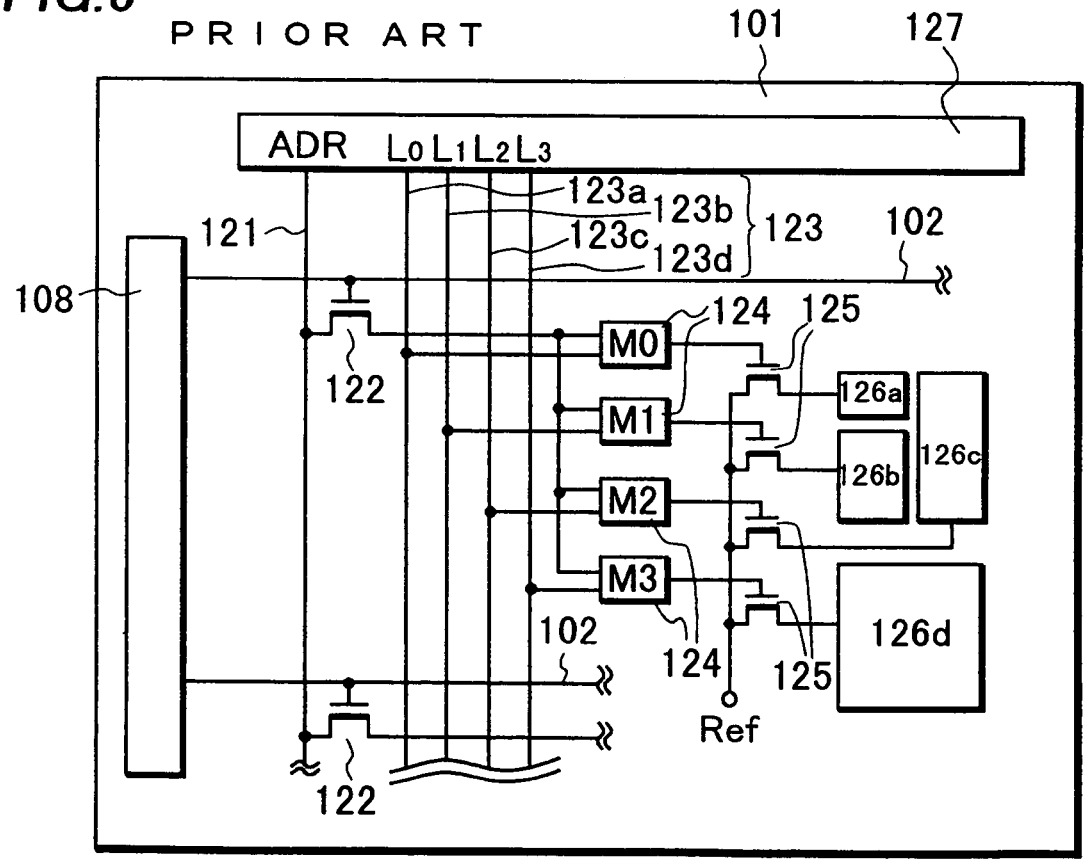
FIG.6 PRIOR ART
FIG. 6 is a circuit diagram of a conventional active matrix display device with a retaining circuit.

The display device of this invention operates mostly in the same manner as the active matrix display device of the prior art shown in FIG. 5. That is, a common analog signal is supplied to a plurality of common image signal lines 12 in the moving picture display mode. First, the gate driver 8 selects a certain gate signal line 2, to which the scanning signal (H level) is applied, and all the pixel element selection TFTs 4 connected to the selected gate signal line 2 turn on. The drain driver 9 selects a certain column selection line 10 and outputs the selection signal to the column selection line. This connects four image signal lines 3*a*, 3*b*, 3*c*, and 3*d* to the common image signal line 12. The same analog image signal is provided to four common image signal lines 12. The analog image signal is supplied to the sub-pixel element electrodes 5*a*-5*d* through the common image signal line 12, column selection TFT 11, image signal line 3, and pixel element selection TFT 4, and retained in the retaining capacitance element 6. The TFTs placed between the common image signal line 12 and the sub-pixel element electrodes 5*a*-5*d* are the column selection TFTs 11*a*-11*d* and the pixel element selection TFTs 4*a*-4*d*, whose gates are connected to each other respectively and which turn on and off simultaneously. Since the same analog signal voltage is supplied to each of the sub-pixel element electrodes 5, each of the sub-pixel element electrodes 5*a*-5*d* act like a single pixel element electrode in the moving picture display mode. Also, the retaining capacitance elements 6*a*-6*d* has the same function as the storage capacitance element 106 of the prior art.

Figure 2A:
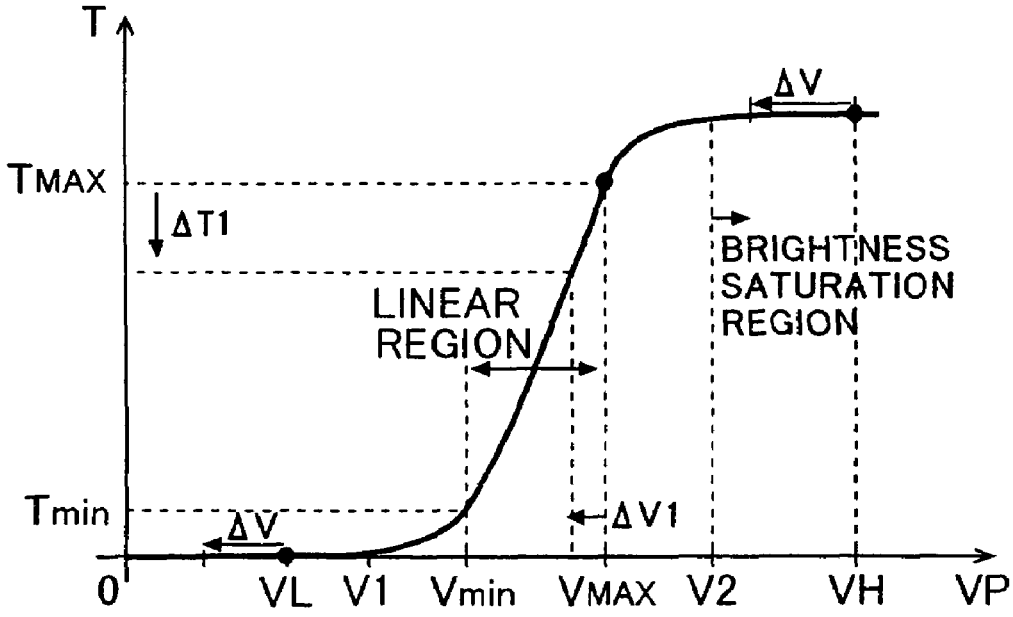
FIGS. 2A and 2B show correlation between the pixel element voltage, which is applied between a pixel element electrode and a common electrode, and the optical transmission of the liquid crystal.
Figure 2B:
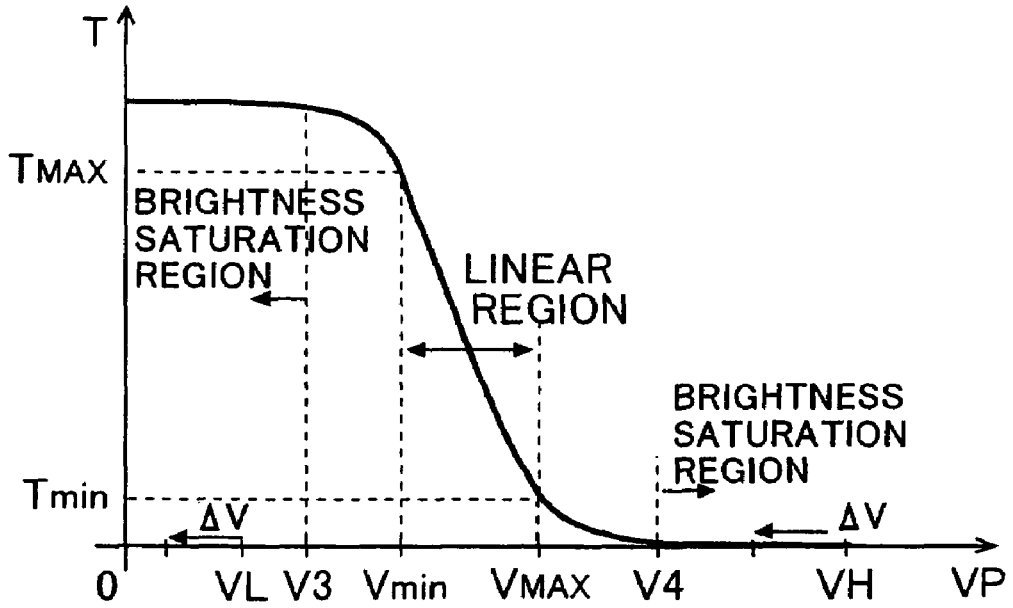

FIG. 2 shows the correlation between a pixel element voltage Vp applied between the common electrode and the sub-pixel element electrode 5 and a transmission factor T of the liquid crystal in this embodiment. FIG. 2A shows the normally-black (NB) mode, in which the transmission factor is at the lowest level when the pixel element voltage Vp=0. FIG. 2B shows the normally-white (NW) mode, where the transmission factor is at the highest level when the pixel element voltage VP=0. In FIG. 2A, as the pixel element voltage Vp gradually increases from 0, the transmission factor T of the liquid crystal starts increasing at a certain point where Vp=V1. Then, with the increase of the pixel element voltage Vp, the transmission factor T keeps increasing. When Vp=V2, the transmission factor T reaches its maximum level and enters a brightness saturation region, where the transmission factor will not increase any further. Likewise, in the NW mode, after Vp=V3, the transmission factor T starts decreasing. When Vp=V4, the transmission factor has reached its minimum level and enters the brightness saturation region, where the transmission factor will not decrease further. In both the NB and NW modes, the correlation between the pixel element voltage Vp and the transmission factor T shows an approximately linear line in the region above Vmin and below Vmax. The analog image signal in the moving picture display mode is an arbitrary voltage within the linear region, above the Vmin and below the Vmax.

(2) Still Picture Display Mode

A still picture is displayed by converting the analog image signal into digital and storing the image signal for one screen display in a frame memory (not shown) in the still picture display mode. Each of high or low bit data of the image signal, which has been converted into digital, is supplied to each of the common image signal lines 12*a*, 12*b*, 12*c*, and 12*d*. The data of the least significant bit digital image signal is inputted to the common image signal line 12*a*. The data of the most significant bit is inputted to the signal line 12*d*. The gate driver 8 sequentially inputs scanning signals to the gate signal lines 2. When one of the gate signal lines 2 receives a high signal, all the pixel element selection TFTs 4 connected to that gate signal line 2 turn on. Each bit dada of the digital image signal is supplied through the pixel element selection TFT 4 to each of the sub-pixel element electrodes 5*a*-5*d* and each of the retaining capacitance elements 6*a*-6*d*. When the gate driver 8 selects another gate signal line 2, turning the gate signal line 2 under the discussion to low, the pixel element selection TFT 4 turns off, making each of the sub-pixel element electrodes 5 floating. The area ratio of the sub-pixel element electrodes 5*a*-5*d* is (5*a*:5*b*:5*c*:5*d*)=(1:2:4:8). The pixel element voltage is supplied to the sub-pixel element electrodes 5*a* based on the least significant bit and the voltage based on the most significant bit is supplied to the sub-pixel element electrode 5*d*, respectively. This turns each sub-pixel element electrode on and off independently. This enables the four-bit or 16-level gray scale display. The method of adjusting the brightness by dividing the pixel element electrode into a plurality of regions and controlling the bright area (the transmissive area for the liquid crystal) is called an area gradation method.

The image signal line for the still picture display mode and that of the moving picture display mode are the same in this embodiment. Thus, it is possible to make a considerable reduction of the circuit size in this embodiment compared to the case disclosed in, for example, Japanese Patent Application No. 2000-282168. In that case, the switching between the circuit operated for the still picture display mode and the circuit for the moving picture display mode is performed.

Next, the voltage retained in the retaining capacitance element 6 will be explained by referring to FIG. 2. As described earlier, the display is made by using the voltage in the linear region above the Vmin and below the Vmax in the moving picture display mode. This voltage can be used. However, the memory element in this embodiment is a kind of DRAM with a retaining capacitance element 6, causing a gradual decrease in the retained voltage due to the leakage from, for example, the pixel element selection TFT 4. Therefore, it is required to refresh the retained voltage in a predetermined cycle. If the voltage in the linear region used in the moving picture display mode is retained in the retaining capacitance element 6, a slight leak causes a drop in the retained voltage and directly affects the transmission factor of the liquid crystal. Suppose the voltage Vp=Vmax is retained in the retaining capacitance element 6 as the ON-state voltage in the NB mode. If the retained voltage, that is, the pixel element voltage Vp, decreases by ΔV1 during the between refreshing operations, the transmission factor also decreases by ΔV1. The retained voltage returns to the original level and the transmission factor also rises to the original level as the refreshing operation is performed. This is recognized as a flicker caused by the brightness difference of ΔT1 on the screen and causes deterioration of display quality. Therefore, the retained voltage is set to be in the brightness saturation region of the pixel element voltage in this embodiment. That is, the voltage is set to the voltage VH, which is higher than the linear region voltage V2 or V4 of the brightness saturation region by at least ΔV. Also, the low voltage retained in the retaining capacitance element 6 is set to the voltage VL, which is lower than the linear region voltage V1 or V3 of the brightness saturation region. As described above, in the brightness saturation region of Vp≦V1, Vp≧V2 or the brightness saturation region of Vp≦V3, Vp ≧V4, the transmission factor of the liquid crystal hardly changes when the pixel element voltage changes. Suppose the retained voltage decreases by ΔV during the time between refreshing operations. The high-voltage retained in the retaining capacitance element 6 is set to be higher than the boundary of the brightness saturation region by at least ΔV. Therefore, even when the retained voltage decreases by ΔV, the retained voltage is still within the brightness saturation region and the transmission factor does not change. When the retained voltage is set within the brightness saturation region, and higher than the linear region by at least ΔV, like VH or VL, the transmission factor T does not change even if the retained voltage decreases by ΔV during the time between refreshing operations or the retained voltage returns to the original level upon a refreshing operation. Therefore, the flicker on the display can be prevented. The decreased amounts of voltage ΔV differ depending on the characteristics of the pixel element selection TFT 4, the leakage from the liquid crystal, and the refreshing cycle. When an N-channel TFT is used as the pixel element selection TFT 4, the leakage can be minimized and the ΔV can be suppressed at the minimum level. The change in the transmission factor can not be recognized visually even if the retained voltage decreases by about ΔV if the retained voltage VH is set to make the transmission factor more than 90%, of the maximum transmission factor of the liquid crystal. Likewise, the retained voltage VL can also be set to make the transmission factor less than 10%. In either case, the voltage should be set at a voltage outside the range of the pixel element voltage applied in the moving picture display mode.

Next, the shapes and the disposition of the sub-pixel element electrodes 5 will be explained. The area ratio of the sub-pixel element electrodes 5*a*-5*d* is (1:2:4:8) like the conventional sub-pixel element electrode 126. However, the disposition of the conventional pixel element electrode 126 has the following problem. That is, the distance between the bright spots differs between the case where the pixel element with the bright sub-pixel element electrode 126*a* is only adjacent to the pixel element with the bright sub-pixel element electrode 126*d*, and the case where the two pixel elements in which all the sub-pixel element electrodes 126*a*-126*d* which are bright are located adjacent to each other. This causes deterioration of the display quality such as jagged lines, dull edges, reduced resolution and an inappropriate mixing of R, G, and B. Therefore, all the pixel elements in this embodiment are rectangles with a common central point. The sub-pixel element electrode 5*a* is a rectangle and is located in the center of the pixel element. Each of the pixel element electrodes 5*b*-5*d* are rectangular shaped with a rectangular opening in the middle. The sub-pixel element electrode is disposed to surround the sub-pixel element electrode which is one size smaller. The outer peripheries of the sub-pixel element electrodes 5*a*-5*d* and the inner peripheries of the sub-pixel element electrodes 5*b*-5*d* are rectangular and the intersecting points of the diagonal lines of these rectangles are located at the same point. That is, these rectangles are concentric. This disposition produces a viewing angle even in vertical and horizontal directions, giving a finer edge to the displayed image. When, for example, only 5*d* is bright, the bright area actually has a ring shape. However, if this ring is small enough, the human eye will recognize the bright area as if it is located at the intersecting point of the diagonal lines of the bright area. Therefore, the difference in the distance between the pixel elements can not be recognized with a part of the sub-pixel element electrodes, or with all of the sub-pixel element electrodes 5*a*-5*d* bright. Therefore, deterioration of the display quality, in which the lower resolution is recognized, can be prevented.

Figure 3A:
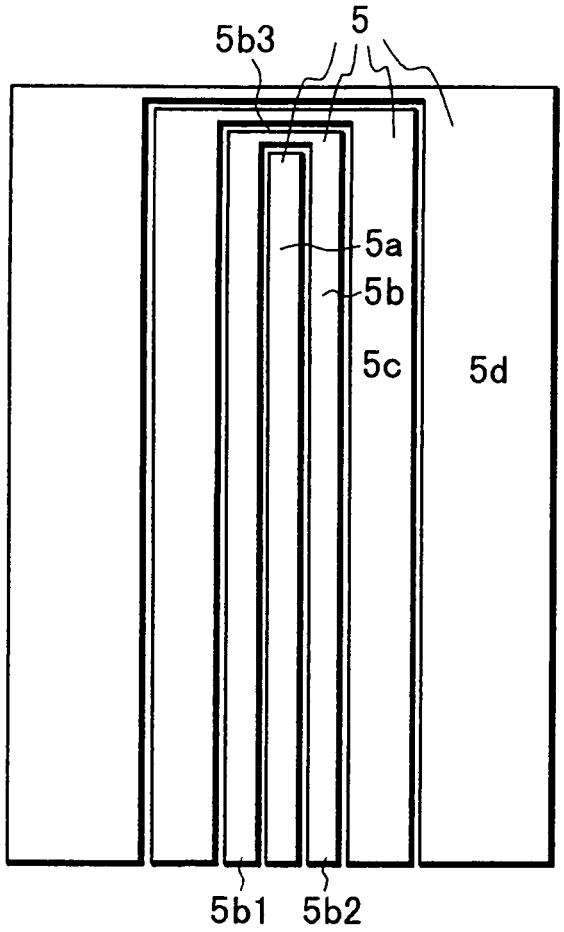
FIGS. 3A and 3B show layouts of sub-pixel element electrodes of this embodiment.
Figure 3B:
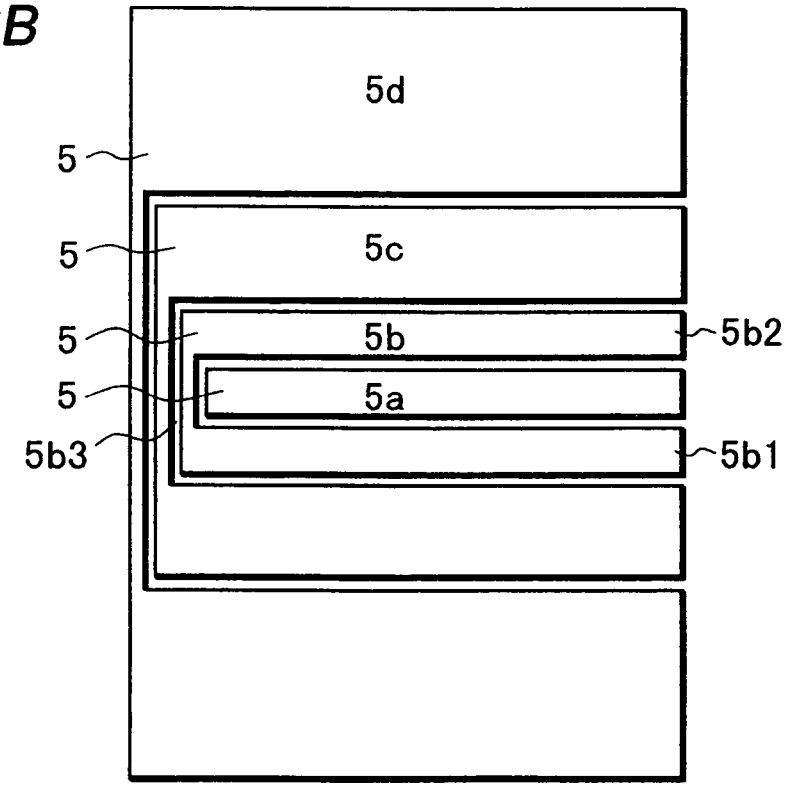

The shape of the sub-pixel element electrode 5 is not limited to the shape in the above description. The shapes shown in FIG. 3 are also preferable. In FIG. 3A, the sub-pixel element electrode 5*a* is disposed in the center of the pixel element with its longitudinal side in the vertical direction. The sub-pixel element electrodes 5*b*1 and 5*b*2, which are connected by the sub-pixel element electrode 5*b*3 disposed at the upper end of these electrodes, is placed at the both sides of the sub-pixel element electrode 5*a*. At the both sides of these electrodes, the sub-pixel element electrodes 5*c* and 5*d* are disposed in the same manner. In FIG. 3B, the sub-pixel element electrode 5 is disposed with its longitudinal side in the horizontal direction. In both FIG. 3A and FIG. 3B, the sub-pixel element electrode 5*b*1 and the 5*b*2 are connected in the same layer by disposing the sub-pixel element electrode 5*b*3 as shown in the figures. It is also possible to connect them to the conduction layer located below through a contact. The common feature about the shape of the sub-pixel element electrode shown in FIG. 1 and FIG. 3 is that the disposition of the sub-pixel element electrode 5 is symmetrical with the axis of the symmetry running vertically and horizontally through the center of the pixel element. As to the disposition shown in FIG. 3A, since the sub-pixel element electrode 5*b*3, which connects the 5*b*1 and 5*b*2 disposed at the right and left sides respectively, is disposed, strictly speaking, the disposition is not symmetrical in vertical direction. However, the 5*b*3 part hardly contributes to the displayed image, making the disposition practically symmetrical. The viewing angle characteristics can be improved by symmetrically disposing the sub-pixel element electrode 5 with the axis of the symmetry in this manner.

Periodically inverting the direction of the electric field applied to the liquid crystal in a predetermined cycle is commonly performed, because constantly applying the electric field in one direction causes deterioration of the liquid crystal. The direction of the electric field is inverted once in each frame in the moving picture display mode of this embodiment. That is, the inverting cycle is about 60 Hz. This is also done in a conventional liquid crystal display device with no retaining circuit. However, inverting in a cycle of several Hz is sufficient for preventing deterioration of the liquid crystal. Also, a refreshing operation for the retained data in a predetermined cycle is required due to leakage from the retaining capacitance element 6. The cycle of the refreshing operation for the retaining capacitance element 6 and the cycle of the inverting operation will be explained by referring to FIG. 4.

Figure 4A:
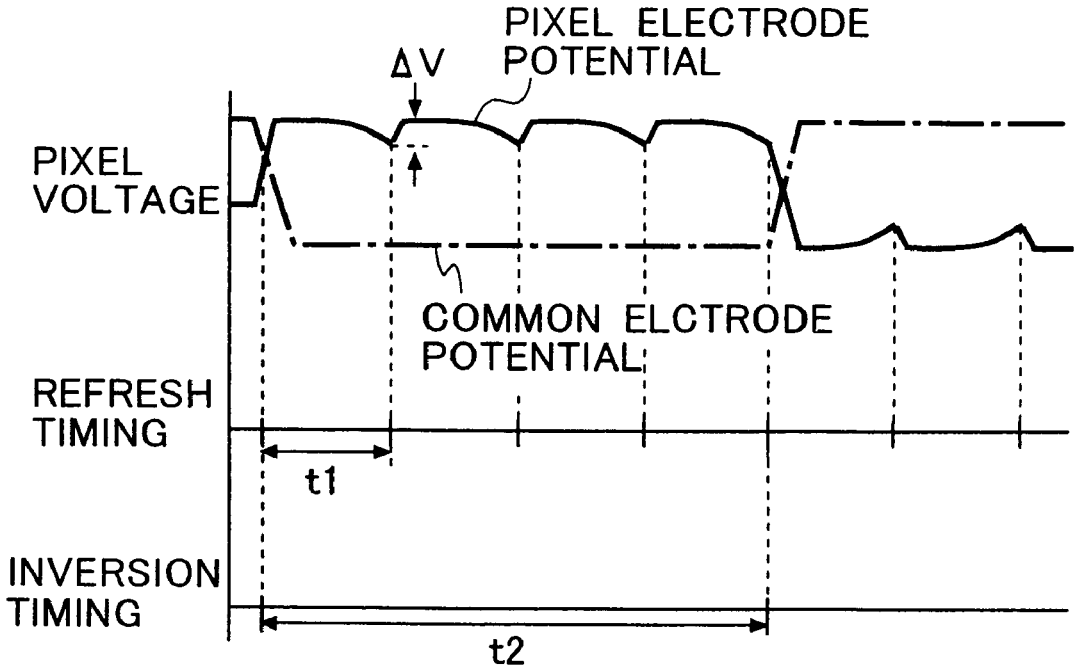
FIGS. 4A and 4B are timing charts of refreshing operation and inverting operation of this embodiment.

As shown in FIG. 4A, the voltage retained in the retaining circuit, that is, the pixel element voltage decreases, by ΔV during the duration t1 due to leakage. The data is maintained by refreshing the voltage in the cycle t1. Suppose the refreshing cycle is 0.1 seconds or 10 Hz. The inverting operation is performed in the cycle of t2, inverting the voltage of the pixel element electrode and the voltage of the common electrode. It is preferable to set the cycle t2 of the inverting operation as slow as possible within a range such that deterioration of the liquid crystal can be prevented because power consumption can be suppressed in above manner. In this embodiment, the cycle is 0.4 seconds or 2.5 Hz. The inverting operation is synchronized with the refreshing operation. At the retaining capacitance element 6, the same data is over-written in the cycle t1 and the inverted data is over-written in the cycle t2.

Figure 4B:
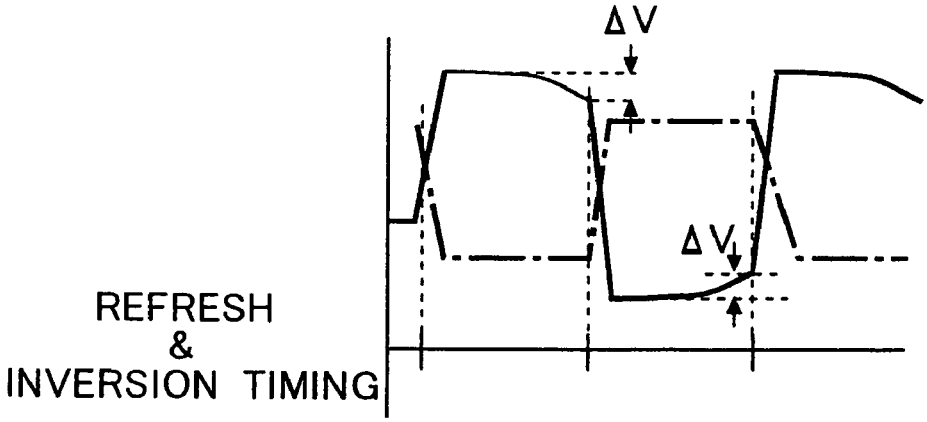

Also, as shown in FIG. 4B, the refreshing cycle t1 and the inverting cycle t2 can be equal. The duration from the data retention to the beginning of the decrease in brightness can be prolonged by minimizing the leakage from the retaining capacitance element 6 and by setting the voltage retained in the retaining capacitance element 6 higher than the linear region voltage of the brightness saturation region. If it is possible to set the refreshing cycle t1 longer, the refreshing cycle t1 can be coincided with the inverting cycle t2. Therefore, the circuit for the refreshing operation can also be used for the inverting operation, leading to the simplification of the circuit configuration. Also, simultaneous operation of these cycles can reduce power consumption.

Next, the explanation about the retaining capacitance element 6 will be explained. The total capacitance value of the retaining capacitance elements 6*a*-6*d* disposed for one pixel element is set to be larger than the capacitance value of the storage capacitance element 106 of an ordinary active matrix display device shown in FIG. 5. When the capacitance value of the retaining capacitance element 6 is large, a decrease in the voltage due to leakage of the electric current becomes smaller, enabling the refreshing cycle t1 to be prolonged. For example, the total capacitance value of the retaining capacitance element 6 is about four times as much as the capacitance value of the conventional storage capacitance element 106. When the capacitance of the storage capacitance element 106 is set to be large in the conventional active matrix display device, it takes a longer time to apply the necessary voltage to the pixel element electrode, making an operation with 60 Hz difficult. However, in the active matrix display device of this embodiment, a common image signal is supplied to four image signal lines 3, and the voltage is applied to each of the sub-pixel element electrodes 5 connected in parallel. Therefore, the capacitance value of each of the retaining capacitance elements 6*a*-6*d* corresponding to each of the sub-pixel element electrodes 5*a*-5*d*, does not have to be set large, thus causing no trouble for the moving picture display. Also, the voltage, which is higher than the voltage in the moving picture display mode, is required to be written in the retaining capacitance element 6 in the still picture display mode. However, the writing can be satisfactorily done by setting the duration of one frame period in the still picture display mode longer than that of the moving picture display mode.

Next, the capacitance value of the retaining capacitance element 6 disposed for each of the pixel elements will be explained. When the pixel element TFT 4 turns from on to off in the moving picture display mode, the sub-pixel element electrode 5 becomes floating and the voltage of the sub-pixel element electrode 5 will change due to a coupling with the common electrode. The amount of the voltage change corresponds to the sum of the capacitance value of the retaining capacitance element 6 and the liquid crystal capacitance, which is formed between each of the sub-pixel element electrodes 5*a*-5*d* and the common electrode through the liquid crystal. The capacitance value of each retaining capacitance element is expressed by Ca, Cb, Cc, or Cd, and the liquid crystal capacitance corresponding to each of the sub-pixel element electrodes 5 is expressed by CLCa, CLCb, CLCc, or CLCd. If the amount of voltage change differs among the sub-pixel element electrodes 5, it will be recognized as flickering.

The first method to prevent the flickering will be explained hereinafter. In general, the amount of voltage change ΔVF of the sub-pixel element electrode 5 is expressed by $$\Delta VF = V\text{on-off}\ Cgs/(Cgs+C+CLC)$$

where Cgs is the capacitance between the gate and the source of the pixel element selection TFT 4, C is the retaining capacitance, and CLC is the liquid crystal capacitance, and Von-off is the difference between the gate voltage which turns on the pixel element selection TFT 4 and the gate voltage which turns off the pixel element selection TFT 4. In the first method, the retaining capacitance and the liquid crystal capacitance are set such that the sum of these capacitances are the same among sub-pixel element electrodes. That is, $$Ca+CLCa=Cb+CLCb=Cc+CLCc=Cd+CLCd.$$

This equalizes the ΔVF among the sub-pixel element electrodes, leading to prevention of the flickering. It is difficult to strictly determine the liquid crystal capacitance value CLC upon the design of the device. Thus, it is acceptable to include some error in the design of the device as long as the error is smaller than CLC-black−CLC-white, where the CLC-black is the liquid crystal capacitance with black displayed and the CLC-white is the liquid crystal capacitance with white displayed.

As the area of the sub-pixel element electrode 5 increases, the corresponding liquid crystal capacitance also increases. Therefore, $$Ca>Cb>Cc>Cd.$$

Also, to fulfill the following equations, which show the relationship between the retaining capacitance element 6 connected to each of the sub-pixel element electrodes and the liquid crystal capacitance, is effective to prevent the flickering.

$$Ca>CLCa$$

$$Cb>CLCb$$

$$Cc>CLCc$$

$$Cd>CLCd$$

The second method for effectively preventing flickering is to fulfill the following condition; the ratio of the liquid crystal capacitance is (CLCa:CLCb:CLCc:CLCd)=(1:2:4:8), as the area ratio of the sub-pixel element electrodes 5 is (1:2:4:8). Here, the ratio of the capacitance of the retaining capacitance elements is set to be (Ca:Cb:Cc:Cd)=(1:2:4:8). Also, the ratio of the channel width of the pixel element selection TFTs 4*a*-4*d* is set to be (W4*a*: W4*b*: W4*c*: W4*d*)=(1:2:4:8). This makes the capacitance ratio of the Cgs between the gate and the source of the pixel element selection transistors 4*a*-4*d* equal. Therefore, it is possible to make the ΔVF almost 0, preventing flickering.

As described above, the voltage retained in the retaining circuit is set outside of the voltage region used in the moving picture display mode, such as the voltage in the brightness saturation region in this invention. Therefore, even if the retained voltage slightly decreases due to leakage, the displayed brightness does not practically change. This improves the display quality.

When the retaining circuit has a retaining capacitance element for holding the voltage, a decrease in the voltage is inevitable. Therefore, the application of this invention is very effective.

When the voltage decrease of the retaining circuit between the refreshing operations is ΔV, the voltage retained in the retaining capacitance element is higher than the voltage in the linear region of the brightness saturation region by at least ΔV. Therefore, the displayed brightness does not practically change between the refreshing operations, preventing flickering in the refreshing cycle. This also improves the display quality.

Additionally, since the sub-pixel element electrode is disposed symmetrically with the axis of the symmetry horizontally and/or vertically run though the center of the pixel element, the viewing angle in the vertical or/and horizontal direction becomes even, making the edge of the displayed image finer.

Furthermore, the smallest pixel element electrode is placed in the center of the pixel element. The second smallest sub-pixel element electrode is disposed to surround the smallest sub-pixel element electrode. In this manner, the n-th smallest sub-pixel element electrode is disposed to surround the (n−1) th smallest sub-pixel element electrode. That is, the sub-pixel element electrodes are rectangles with the same central point. Therefore, even though the bright area has a ring shape, the human eye will recognize the bright area as if it is located at the center, or at the intersecting point of the diagonal lines of the actual bright area. The deterioration of the display quality, in which lower resolution is recognized, can be prevented.

When the still picture is displayed by the retaining circuit with the retaining capacitance element for holding the voltage, the second cycle for the inverting operation is an integral multiple of, or the same as the first cycle of the refreshing operation. The frequency of re-charging the retained voltage can be reduced, leading to a further reduction in power consumption in the still picture display mode compared to the case where the inverting operation and the refreshing operation are independently performed with different timings. Also, part of the circuits for the inverting operation can also be used as the circuits for the refreshing operation, reducing the circuit area, further reducing power consumption, and improving the yield rate.

Furthermore, the data is supplied to the retaining circuit corresponding to each of the sub-pixel element electrodes through different image signal lines in the still picture display mode. The same voltage is applied to a plurality of the sub-pixel element electrodes corresponding to one pixel element in the moving picture display mode. In this manner, a significant part of the circuits are shared by the moving picture display mode and the still picture display mode, enabling a reduction in the number of the elements, a reduction in pixel element size, and the higher resolution of the display device. Also, as in the embodiment above, the multiple-gradation display is possible in the still picture display mode by integrating the multiple-bit retaining circuits in one pixel element for using the area gradation.

The flickering, which takes place because of the difference in the voltage change among the sub-pixel element electrodes can be prevented by one of the following features, thereby leading to an active matrix display device with a high quality display. The sum of the capacitance value C of the retaining capacitance element and the liquid crystal capacitance CLC, which is formed by the sub-pixel element electrode with the common electrode with the liquid crystal therebetween is the same among the sub-pixel element electrodes. The larger the capacitance value C of the retaining capacitance element, the smaller the corresponding sub-pixel element electrode. The capacitance value C of the retaining capacitance element is larger than the liquid crystal capacitance CLC formed by the sub-pixel element electrode with the common electrode with the liquid crystal therebetween. And, the capacitance value C of the retaining capacitance element corresponding to each of the sub-pixel element electrodes and the channel width W of the pixel element selection transistor are determined according to the area of the corresponding sub-pixel element electrode.

The above is a detailed description of the particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. An active matrix display device comprising:

a pixel element;

a pixel element electrode disposed for the pixel element;

a plurality of sub-pixel element electrodes disposed for the pixel element electrode, each of the sub-pixel element electrodes having a different surface area, receiving an equal voltage according to an image signal in a moving picture display mode and receiving a respective bit signal of a digital image signal in a still picture display mode; and a plurality of retaining circuits disposed for the pixel element electrode, each of the retaining circuits corresponding to one of the sub-pixel element electrodes, retaining a voltage, and supplying the voltage to the corresponding sub-pixel element electrode, wherein the sub-pixel element electrodes are symmetrically disposed with respect to a first line of symmetry passing substantially through a center of the pixel element, with respect to a second line of symmetry passing substantially through the center of the pixel element, or with respect to both the first line and the second line, the first line and the second line being substantially orthogonal to each other.

2. The active matrix display device of claim 1, wherein the smallest sub-pixel element electrode among the sub-pixel element electrodes is disposed substantially in the center of the pixel element, and the sub-pixel element electrode surrounds a smaller sub-pixel element electrode.

3. The active matrix display device of claim 2, wherein the smallest sub-pixel element electrode has a rectangular shape and the sub-pixel element electrodes larger than the smallest sub-pixel element electrode have a rectangular shape with a rectangular opening in a center thereof.

4. The active matrix display device of claim 1, further comprising a plurality of pixel element selection transistors, each of the pixel element selection transistors connecting one of image signal lines sending an image signal to the pixel element electrode with a corresponding retaining circuit, wherein all of the pixel element selection transistors turn on or off simultaneously.

5. The active matrix display device of claim 1, wherein each of the retaining circuits comprises a capacitance element, and the capacitance elements function as supplemental storage capacitance elements in a moving picture display mode.

6. The active matrix display device of claim 1, wherein each of the sub-pixel element electrodes receives an equal voltage according to an image signal in a moving picture display mode.

7. An active matrix display device comprising:

a first substrate and a second substrate;

a liquid crystal disposed between the first substrate and the second substrate;

a plurality of pixel element electrodes disposed on the first substrate;

a plurality of retaining circuits disposed on the first substrate, the retaining circuits corresponding to the pixel element electrodes, each of the retaining circuits retaining a voltage, the voltages retained by the retaining circuits being supplied to the corresponding pixel element electrodes to form an image;

a plurality of sub-pixel element electrodes provided for each of the pixel element electrodes, each of the plurality of the sub-pixel element electrodes having a different surface area, and all of the sub-pixel element electrodes of one of the pixel element electrodes receiving an equal voltage according to an image signal in a moving picture display mode and receiving respective bit signals of a digital image signal in a still picture display mode; and a common electrode disposed on the second substrate, the common electrode facing the pixel element electrodes, wherein the display device is configured to perform a refreshing operation for refreshing the voltages retained by the retaining circuits with a first cycle, and an inverting operation for inverting the voltages retained by the retaining circuits, so that a direction of an electric field applied to the liquid crystal is inverted, with a second cycle, the inverting operation coinciding with one of the refreshing operations.

8. The matrix display device of claim 7, wherein the second cycle is a multiple of the first cycle.

9. The active matrix display device of claim 7, wherein the first cycle and the second cycle are equal.

10. The active matrix display device of claim 7, further comprising a plurality of pixel element selection transistors, each of the pixel element selection transistors connecting one of image signal lines sending the image signal to the pixel element electrodes with a corresponding retaining circuit, wherein all of the pixel element selection transistors corresponding to one of the pixel element electrodes turn on or off simultaneously.

11. The active matrix display device of claim 7, wherein each of the retaining circuits comprises a capacitance element, and the capacitance elements function as supplemental storage capacitance elements in a moving picture display mode.

12. An active matrix display device comprising:

a first substrate and a second substrate;

a liquid crystal disposed between the first substrate and the second substrate;

a plurality of pixel element electrodes disposed on the first substrate;

a plurality of sub-pixel element electrodes disposed for each of the pixel element electrodes and having different surface areas, each of the sub-pixel element electrodes of one of the pixel element electrodes receiving an equal voltage according to an image signal in a moving picture display mode and receiving a respective bit signal of a digital image signal in a still picture display mode;

a plurality of retaining circuits disposed on the first substrate, each of the retaining circuits corresponding to one of the sub-pixel element electrodes and comprising a capacitance element retaining a voltage; and a common electrode disposed on the second substrate, the common electrode facing the pixel element electrodes, wherein each of the sub-pixel element electrodes corresponding to one of the pixel element electrodes possesses an equal capacitance, the capacitance being a sum of a capacitance of the corresponding capacitance element and a liquid crystal capacitance formed between the corresponding sub-pixel element electrode and the common electrode through the liquid crystal.

13. The active matrix display device of claim 12, further comprising a plurality of pixel element selection transistors, each of the pixel element selection transistors connecting one of image signal lines sending an image signal to the pixel element electrodes with a corresponding retaining circuit, wherein all of the pixel element selection transistors corresponding to one of the pixel element electrodes turn on or off simultaneously.

14. The active matrix display device of claim 12, wherein each of the retaining circuits comprises a capacitance element, and the capacitance elements function as supplemental storage capacitance elements in a moving picture display mode.

15. An active matrix display device comprising:

a first substrate and a second substrate;

a liquid crystal disposed between the first substrate and the second substrate;

a plurality of pixel element electrodes disposed on the first substrate;

a plurality of sub-pixel element electrodes disposed for each of the pixel element electrodes and having different surface areas, each of the sub-pixel element electrodes of one of the pixel element electrodes receiving an equal voltage according to an image signal in a moving picture display mode and receiving a respective bit signal of a digital image signal in a still picture display mode;

a plurality of retaining circuits disposed on the first substrate, each of the retaining circuits corresponding to one of the sub-pixel element electrodes and comprising a capacitance element retaining a voltage; and a common electrode disposed on the second substrate, the common electrode facing the pixel element electrodes, wherein a smaller sub-pixel element electrode among the sub-pixel element electrodes of one of the pixel element electrodes corresponds to a retaining circuit with larger capacitance among the retaining circuits of said one of the pixel element electrodes.

16. The active matrix display device of claim 15, further comprising a plurality of pixel element selection transistors, each of the pixel element selection transistors connecting one of image signal lines sending an image signal to the pixel element electrodes with a corresponding retaining circuit, wherein all of the pixel element selection transistors corresponding to one of the pixel element electrodes turn on or off simultaneously.

17. The active matrix display device of claim 15, wherein each of the retaining circuits comprises a capacitance element, and the capacitance elements function as supplemental storage capacitance elements in a moving picture display mode.

18. An active matrix display device comprising:

a first substrate and a second substrate;

a liquid crystal disposed between the first substrate and the second substrate;

a plurality of pixel element electrodes disposed on the first substrate;

a plurality of sub-pixel element electrodes disposed for each of the pixel element electrodes and having different surface areas, each of the sub-pixel element electrodes of one of the pixel element electrodes receiving an equal voltage according to an image signal in a moving picture display mode and receiving a respective bit signal of a digital image signal in a still picture display mode;

a plurality of retaining circuits disposed on the first substrate, each of the retaining circuits corresponding to one of the sub-pixel element electrodes and comprising a capacitance element retaining a voltage; and a common electrode disposed on the second substrate, the common electrode facing the pixel element electrodes, wherein a capacitance of one of the capacitance elements is larger than a liquid crystal capacitance formed between the common electrode and the corresponding sub-pixel element electrode through the liquid crystal.

19. The active matrix display device of claim 18, further comprising a plurality of pixel element selection transistors, each of the pixel element selection transistors connecting one of image signal lines sending an image signal to the pixel element electrodes with a corresponding retaining circuit, wherein all of the pixel element selection transistors corresponding to one of the pixel element electrodes turn on or off simultaneously.

20. The active matrix display device of claim 18, wherein each of the retaining circuits comprises a capacitance element, and the capacitance elements function as supplemental storage capacitance elements in a moving picture display mode.

21. An active matrix display device comprising:

a first substrate and a second substrate;

a liquid crystal disposed between the first substrate and the second substrate;

a plurality of pixel element electrodes disposed on the first substrate;

a plurality of sub-pixel element electrodes disposed for each of the pixel element electrodes and having different surface areas, each of the sub-pixel element electrodes of one of the pixel element electrodes receiving an equal voltage according to an image signal in a moving picture display mode and receiving a respective bit signal of a digital image signal in a still picture display mode;

a plurality of pixel element selection transistors, each of the pixel element selection transistors corresponding to one of the sub-pixel element electrodes and selecting the corresponding sub-pixel element electrode;

a plurality of retaining circuits disposed on the first substrate, each of the retaining circuits corresponding to one of the sub-pixel element electrodes and comprising a capacitance element retaining a voltage; and a common electrode disposed on the second substrate, the common electrode facing the pixel element electrodes, wherein the surface area of one of the sub-pixel element electrodes determines a capacitance of the corresponding capacitance element and a channel width of the corresponding pixel element selection transistor.

22. The active matrix display device of claim 21, further comprising a plurality of pixel element selection transistors, each of the pixel element selection transistors connecting one of image signal lines sending an image signal to the pixel element electrodes with a corresponding retaining circuit, wherein all of the pixel element selection transistors corresponding to one of the pixel element electrodes turn on or off simultaneously.

23. An active matrix display device comprising:

a pixel element;

a pixel element electrode disposed for the pixel element;

a plurality of sub-pixel element electrodes disposed for the pixel element electrode, each of the sub-pixel element electrodes having a different surface area, receiving an equal voltage according to an image signal in a moving picture display mode and receiving a respective bit signal of a digital image signal in a still picture display mode; and a plurality of retaining circuits disposed for the pixel element electrode, each of the retaining circuits corresponding to one of the sub-pixel element electrodes, retaining a voltage, and supplying the voltage to the corresponding sub-pixel element electrode.

* * * * *